US007416523B2

(12) United States Patent
Mackel et al.

(10) Patent No.: US 7,416,523 B2
(45) Date of Patent: Aug. 26, 2008

(54) SEPARATOR HAVING A DOUBLE-CONE DRUM MADE OF METAL

(75) Inventors: Wilfried Mackel, Oelde (DE); Angelika Voltmann, Rheda-Wiedenbrück (DE)

(73) Assignee: Westfalia Separator AG, Oelde (DE)

( * ) Notice: Subject to any disclaimer, the term of this patent is extended or adjusted under 35 U.S.C. 154(b) by 0 days.

(21) Appl. No.: 11/493,586

(22) Filed: Jul. 27, 2006

(65) Prior Publication Data

US 2007/0023330 A1 Feb. 1, 2007

(30) Foreign Application Priority Data

Jul. 28, 2005 (DE) ..... 10 2005 035 351
Jun. 17, 2006 (DE) ..... 10 2006 027 893

(51) Int. Cl.
*B04B 1/08* (2006.01)

(52) U.S. Cl. ..... 494/70

(58) Field of Classification Search ... 210/360.1–380.3; 494/68–73, 2–4
See application file for complete search history.

(56) References Cited

U.S. PATENT DOCUMENTS

| | | | | |
|---|---|---|---|---|
| 2,017,734 A | | 10/1935 | Sandstrom | |
| 2,286,354 A | | 6/1942 | Fitzsimmons | |
| 3,933,649 A | * | 1/1976 | Ahlfors | 210/378 |
| 4,026,462 A | * | 5/1977 | Tenthoff et al. | 494/70 |
| 4,209,341 A | | 6/1980 | Houben | |
| 4,816,152 A | * | 3/1989 | Kalleberg | 210/360.2 |

FOREIGN PATENT DOCUMENTS

| | | | |
|---|---|---|---|
| DE | 169 365 | | 3/1905 |
| DE | 699 929 | | 12/1940 |
| DE | 74 35598 | | 6/1976 |
| DE | 27 60 069 | C2 | 1/1979 |
| DE | 89 05 985 | U1 | 8/1989 |
| JP | 62-117649 | | 5/1987 |
| JP | 1-224062 | * | 9/1989 |

* cited by examiner

*Primary Examiner*—Charles E Cooley
(74) *Attorney, Agent, or Firm*—Barnes & Thornburg LLP

(57) ABSTRACT

A separator for the clarification or separation of liquids includes a double-cone drum having a metal conical drum top part and a metal conical drum bottom part. The drum top part and the drum bottom part are made as metal plates and the double-cone drum has a largest inside diameter greater than 1000 mm. A disk stack including a stack of conical separating disks is arranged in the double-cone drum. The drum bottom part has at least two drum shell sections with different outer angles of taper with respect to an axis of rotation of the double-cone drum.

20 Claims, 2 Drawing Sheets

SEPARATOR HAVING A DOUBLE-CONE DRUM MADE OF METAL

BACKGROUND AND SUMMARY

This non-provisional application claims priority to and benefit of German Application 10 2005 0351.7, filed Jul. 28, 2005, and German Application 10 2006 027 893.3, filed Jun. 17, 2006, the disclosures of which are hereby incorporated by reference herein.

BACKGROUND AND SUMMARY

The present disclosure relates to a separator for the clarification and/or separation of liquids and a method for clarification of multi-phase separation of a product.

Nozzle-type separators of known construction are shown, for example, by Japanese Patent Document JP 62-117649 A of the above-mentioned type, and Technical Specification Sheet: CH-30 GOF Separator-Nozzle-Centrifugator, Alfa Laval AB, Printing PD 4149 en/0110. The exterior parts of such separator drums are produced, for example, by using forging methods.

Furthermore, U.S. Patent Document U.S. Pat. No. 2,286,354 shows a separator with mutually screwed-together massive drum bottom parts and drum top parts.

U.S. Patent Document U.S. Pat. No. 2,017,734 illustrates a separator without a solids discharge in a construction as a separator.

German Patent Document DE 27 60 069 C2 shows a pendulous flat-bottom centrifuge.

German Patent Document DE 89 05 985 U1 shows a basket centrifuge.

German Patent Document DE 699 929 shows a centrifugal drum with a rotating ring integrated in the drum construction.

German Patent Document DE 169 365 C shows a centrifugal device for the production of starch.

In addition, it is known from German Patent Document DE 74 35 598 U to create a centrifugal drum for a continuously operating sugar centrifuge, in which case the centrifugal drum has a drum shell which consists of one piece and is created in a rolling operation from a thin circular special-steel plate blank which has a wall thickness of 3.5 mm. The drum has a maximal diameter of 1,100 mm.

In the case of centrifuges of known construction, there is the demand for new constructive methods for improving the clarification and separation results by separators, particularly with respect to the processing of products whose particle size is to a large degree caused by mechanical stress or by agglomeration effects caused over time.

The present disclosure addresses the above-noted demand.

The present disclosure relates to a separator for the clarification and/or separation of liquids. The separator includes a double-cone drum, which has a conical drum top part made of metal and a conical drum bottom part made of metal. Also included is a disk stack including a stack of conical separating disks being arranged in the drum. The drum top part and the drum bottom part are made of metal plates and the largest inside diameter of the drum is greater than 1,000 mm. At least the drum bottom part, relative at least to an exterior surface of a drum shell and in an axial direction, has at least two drum shell sections with respective, different angles of taper $\alpha 1$, $\alpha 2$ with respect to an axis of rotation of the drum.

Construction of the separator is simple and cost-effective. As a result of two different angles of taper, on the outer circumference and on the inner circumference of the drum bottom par, a stable construction is created which, in contrast to the state of the art, may also be constructed as a deep-drawn part.

As a result of two cones in the drum bottom part, a stiff formation is created whose natural frequency may be above the rotational operating speed. To this extent, the separator, according to the present disclosure, is operated at a rotational speed which is more than 30% below the natural frequency. Even an overhung bearing of the drum can be implemented.

A stressing of the particles of the product to be processed in the "large" drum is very low, so that also sensitive products can be optimally processed.

The diameter of the drum amounts to 1,000 mm or more. Constructions with a drum diameter of 1,500 mm or more are also conceivable.

Preferably the ratio between the largest inside diameter $D_1$ of the drum and the thickness or strength of the metal plates of the drum top part and of the drum bottom part is less than 1/50, particularly less than 1/100.

The energy demand can as a rule be lowered in comparison to existing constructions.

The noise emissions are also considerably reduced.

The drum top part and/or the drum bottom part are manufactured from metal plates by forming, in a non-tensioning manner, for example, by deep-drawing or pressing or roller tooling or the like.

By largely using metal plates of standard quality, that is, of a quality suitable for deep drawing or for bending or pressing operations for the production, the manufacturing costs are clearly reduced because the use of expensive forged pieces made of special materials is not required.

The volume of the drum, at a diameter of 1,000 mm or more amounts to at least 300 liters and, at a diameter of 2,000 or more, to at least 2,000 liters.

Since the radius is linearly entered into the formula for computing the centrifugal acceleration, it becomes clear that the rotational speed of the drum with such a large diameter or volume only needs to be relatively low in order to obtain a clarifying or separating effect which corresponds to that of a small separator at high rotational speeds.

The distributor body tapers in the upward direction, bounding distributor ducts in the downward direction. The distributor ducts are bounded upwardly by a conical covering and, in the circumferential direction, are bounded by ribs between the covering and the distributor body.

The present disclosure also relates to a method for the clarification or two- or three-phase separation of a particle-sensitive product, such as a product which has a sensitive reaction to acceleration effects, such as shear and pressure. In such a case, the separating operation takes place by a separator, according to the present disclosure, at a circumferential speed at the largest inside diameter between 10 and 50 m/sec. In this manner, the product can be subjected without any problem to the desired clarifying or separating operation. The resulting dwell time of the product in the drum has a positive influence on the clarification and separation effect.

Other aspects of the present disclosure will become apparent from the following descriptions when considered in conjunction with the accompanying drawings.

DETAILED DESCRIPTION

Figure 1:
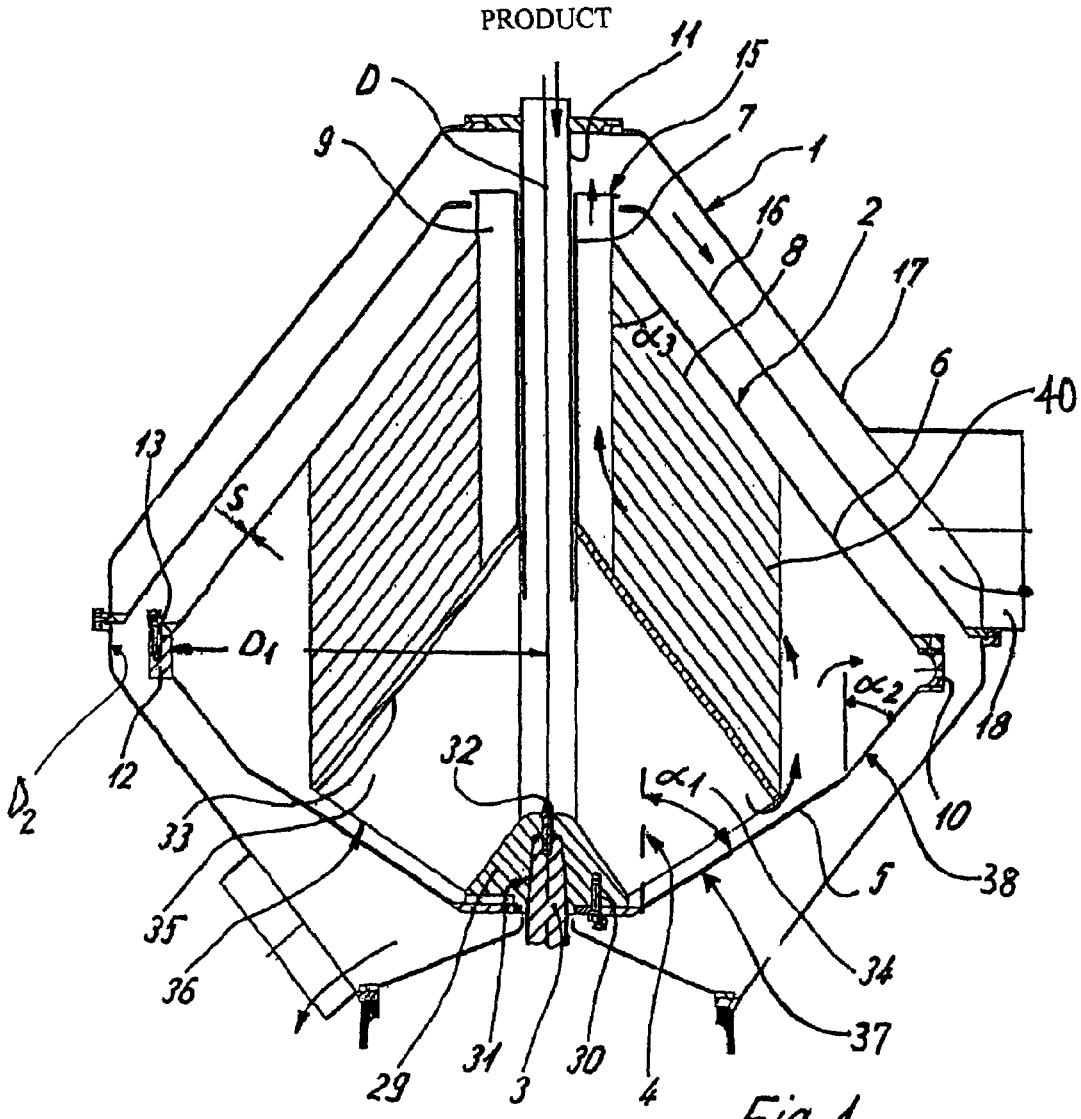
FIG. 1 is a sectional view of a hood and a drum of a first embodiment of a separator according to the present disclosure.

FIG. 1 shows a hood 1 and a drum 2 of a separator by which a liquid product can be clarified. A drive and a control of the separator are not shown.

The drum 2 has a vertical axis of rotation D and is placed onto a driving screw 3 which projects from below into a distributor 4. A feeding tube 11 extends into the drum 2 from above. It is within the scope of the present disclosure that, embodiments of a different type, for example, separators with a product feeding through the lower screw 3 or with an overhead drum (not shown here) are also conceivable.

The drum 2 has a drum bottom part 5 and a drum top part 6 which both have a conical shape for achieving a sufficient stability despite the use of thin metal plates for their production. If, in contrast, one of the drum parts 5, 6, for example, the drum bottom part 5, were constructed as a plane disk and the conical drum top part 6 were placed on the latter, this would be too unstable in view of selected large diameters and as a result of the vibrations occurring in a case of a plane in the manner of a plane membrane. A double-cone drum is therefore particularly advantageous.

According to FIG. 1, the drum bottom part 5, as well as the drum top part 6, or the lid, are made or formed of a thin metal plate of a thickness S in the conical area. It is useful to produce the drum top part 5 and the drum bottom part 6, for example, by a pressing forming process from a disk-shaped metal plate, such as a circular metal blank. As an alternative, it is within the scope of the present disclosure to roll or to round a cut-to-shape piece of metal plate and to process it in the area of a longitudinal seam by welding together to form a conical drum part with a closed circumference.

On an axially lower, interior area, the drum bottom part 6 is connected to an underside of a lower distributor body 29, for example, by a screws 30. Distributor body 29 bounds a distributor inlet in a downward direction and has a type of conical blind hole 31 into which the driving screw 3 engages. The distributor body 29 and the driving screw 3 are mutually connected by a screw 32 arranged in the axis of rotation D.

The distributor body 29 is advantageous because the drum bottom part 5 with its thin metal plate walls cannot itself be placed on the rotatably disposed driving spindle or screw 3. A bearing of the drum 2 is therefore one-sided.

The distributor body 29 is conically tapered in an upward direction and forms a lower boundary of a distributor inlet. In the upward direction, the distributor inlet is bounded by a conical disk-type covering 33. The distributor 4 has a large cross-section that includes two large-volume distributor ducts 34, 35 having a rectangular cross-section. These distributor ducts 34, 35 are necessary for guiding a required flow quantity into the drum 2. The distributor ducts 34, 35 guide exiting liquid in an area of their outlets into the drum 2 onto an interior wall of the drum bottom part 6. The distributor ducts 34, 35 are bounded by ribs 36 which extend between the covering 33 and the distributor body 29 and are connected, for example, welded together, at these two elements. Four, six or more ribs 36 are symmetrically distributed on the circumference.

A disk stack 8 including of a stack of conical separating disks 40 is arranged in the drum 2 on a shaft 7 of the distributor 4. The conical separating disks 40 may include rising ducts. In the disk stack 8, at the interior distributor shaft 7, a discharge duct 9 for a liquid phase is constructed. Discharge duct 9 extends axially through the disk stack 8 and is formed by edge recesses in edges of the disks and/or grooves or the like in the distributor shaft 7. Liquid flows out at an upper end of the drum 2 at a free overflow outlet 15. In a selected design of the drum 2, a free overflow outlet 15 may be preferable to a centripetal pump.

In an area in which it surrounds the drum top part 6, the hood 1, as shown in FIG. 1, has an inner hood part 16 and an outer hood part 17, between which parts 16, 17 the liquid is collected which flows out of the drum 2 and flows to a discharge 18. In contrast, in an area of the drum bottom part 6, the hood 1 is constructed in one layer in a manner of a solids catching device 19 with an outlet 20. This area may also have a different construction depending on the occurring quantity of solids.

A discharge of a solids phase takes place by nozzles 10 at a largest inside diameter $D_1$ of the drum 2. These nozzles 10 may have a relatively large diameter of 5 mm or more, 10 mm or more, or 20 mm or more, so that a risk of clogging the nozzles 10 is very low. The nozzles 10 may be directed or sloped radially to the outside, particularly such that an exiting phase is discharged at an angle of from 30° to 60° with respect to a tangent to the drum 2 or an outer shell of the drum 2. A closing mechanism (not shown) may also be assigned to the solids discharge openings or nozzles 10. A ratio between an inner axial length, as shown by axis of rotation D, and the largest inside diameter of the drum 2 is between 0.5 and 2.

The drum top part 6 has a constant angle of taper $\alpha 3$, which is between 30° and 60 °.

The drum bottom part 5 has two sections 37, 38 in an axial direction which have different angles of taper $\alpha 1$, $\alpha 2$ with respect to the axis of rotation D. Angle of taper $\alpha 1$ may be between 15° and 60°. The two different angles of taper $\alpha 1$, $\alpha 2$, relative at least to the outer shell and also to the inner shell, significantly increase the stability of the drum bottom part 6. In an illustrative embodiment of the separator, $\alpha 1 > \alpha 2$.

On an outer circumferential edge in an area of the largest inside diameter $D_1$, the drum bottom part 5 and the drum top part 6, in an area of ring-type thickenings 12, are mutually connected by studs 13. Other types of connections are conceivable.

If the respective angles of taper $\alpha 1$, $\alpha 2$, $\alpha 3$ of the drum parts 5, 6 are between 15° and 60°, and the largest inside diameter $D_1$ of the drum 2 is more than 2,000 mm, the centrifuge or separator, according to the present disclosure, may have a volume of more than twenty times the volume of a conventional separator.

The drum 2 is operated during an operation at a relatively low rotational operating speed in comparison to smaller separators, which leads to circumferential speeds at a largest outside diameter $D_2$ of 50 m/sec or more. For particle-sensitive products, lower circumferential speeds at the largest outside diameter $D_2$ between 10 and 50 m/sec. are conceivable. An overhung bearing of the drum 2 is conceivable.

A stressing of the particles of the product to be processed is very low at low circumferential speeds, so that sensitive products can be optimally processed in accordance with the separators of the present disclosure.

Dwell time of particles in the drum 2 and in a centrifugal field is extended by the large volume of the drum 2, which has a positive influence on the clarifying performance of such a drum 2.

Figure 2:
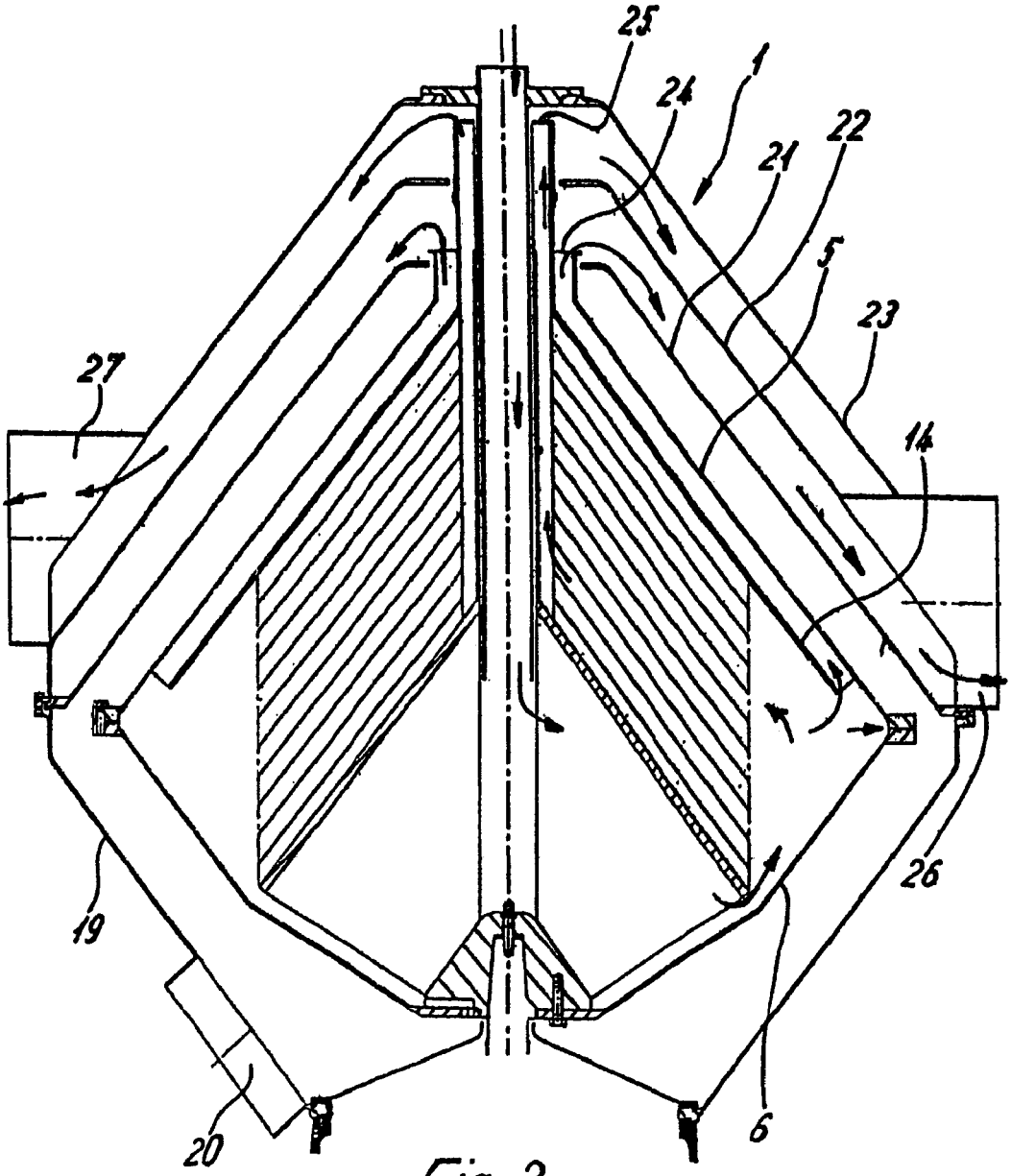
FIG. 2 is a sectional view of a hood and a drum of a second embodiment of a separator according to the present disclosure.

FIG. 1 shows an embodiment of a separator as a clarifying machine, for the clarification of a product into "liquid/solid" phases. FIG. 2 shows a two-phase separating machine, for the separation of a product into "liquid/liquid" phases, in contrast to FIG. 1, with the second liquid phase being discharged by a separating disk 14 above the disk stack 8.

In an area in which it surrounds the drum top part 6, the hood 1, shown in FIG. 2, has an inner hood part 21, a center hood part 22 and an outer hood part 23. Between the hood parts 21, 22, 23, liquid phases are collected which flow out of the drum 2 at two free overflow outlets 24, 25 and between which they flow off to discharges 26, 27. In an area of the drum bottom part 6, the hood 1 is constructed in a "single layer" with a safety outlet 20. A multilayer characteristic of hood parts 21, 22, 23 includes a noise-damping effect.

Three-phase machines, for the separation and clarification into "liquid/liquid/solid" phases, may also be implemented, in accordance with the present disclosure (not shown).

The drum 2 may be disposed in an overhung manner (not shown). In this manner, a membrane-free stiff construction is created which has a natural frequency which may be above, possibly more than 30% above, the rotational operating speed.

Although the present disclosure has been described and illustrated in detail, it is to be clearly understood that this is done by way of illustration and example only and is not to be taken by way of limitation. The scope of the present disclosure is to be limited only by the terms of the appended claims.

We claim:

1. A separator for the clarification or separation of liquids, comprising:

a double-cone drum having a metal conical drum top part and a metal conical drum bottom part, the drum top part and the drum bottom part being made as metal plates and the double-cone drum having a largest inside diameter greater than 1000 mm;

a disk stack including a stack of conical separating disks arranged in the double-cone drum;

at least the drum bottom part, relative at least to an outer surface of the drum and in an axial direction, having at least two drum shell sections with different outer angles of taper with respect to an axis of rotation of the double-cone drum; and wherein the drum top part and the drum bottom part include metal sheets which are shaped to form a conical pipe piece with a closed circumference and, in an area of a longitudinal seam, are closed by welding.

2. The separator according to claim 1, wherein a ratio between the largest inside diameter of the drum and a thickness of the metal plates of the drum top part and of the drum bottom part is less than 1/50.

3. The separator according to claim 1, wherein for a discharge of a solids phase, nozzles are constructed at the largest inside diameter of the drum.

4. The separator according to claim 3, wherein the nozzles have a diameter of at least 5 mm.

5. The separator according to claim 3, wherein the nozzles have a diameter of greater than 10 mm.

6. The separator according to claim 1, wherein a ratio between the largest inside diameter of the drum and a thickness of the metal plates of the drum top part and of the drum bottom part is less than 1/100.

7. The separator according to claim 1, wherein the drum top part and the drum bottom part are produced from metal plates in a forming process.

8. The separator according to claim 1, wherein a circumferential speed at a largest outside diameter of the drum at a rotational operating speed is more than 50 m/sec.

9. The separator according to claim 1, wherein a volume of the drum at a largest inside diameter greater than 1,000 mm is at least 300 liters.

10. The separator according to claim 1, wherein a volume of the drum at a largest inside diameter of 2,000 mm or more is at least 2,000 liters.

11. The separator according to claim 1, wherein the drum is disposed in an overhung manner.

12. The separator according to claim 1, wherein an angle of taper of the drum top part is constant and is between 30° and 60°.

13. The separator according to claim 1, wherein an angle of taper of the drum bottom part is between 15° and 60°.

14. The separator according to claim 1, wherein a ratio between an inner axial length and the largest inside diameter of the drum is between 0.5 and 2.

15. The separator according to claim 1, further including at least one free overflow from the drum for discharging liquid phases.

16. The separator according to claim 1, further including a hood constructed in several layers in an area surrounding the drum top part.

17. A method for a clarification or two- or three-phase separation of a particle-sensitive product, wherein the separation process takes place by a separator according to claim 1 operated at a circumferential speed of between 10 and 50 m/sec.

18. A separator for the clarification or separation of liquids, comprising:

a double-cone drum having a metal conical drum top part and a metal conical drum bottom part, the drum top part and the drum bottom part being made as metal plates and the double-cone drum having a largest inside diameter greater than 1000 mm;

a disk stack including a stack of conical separating disks arranged in the double-cone drum;

at least the drum bottom part, relative at least to an outer surface of the drum and in an axial direction, having at least two drum shell sections with different outer angles of taper with respect to an axis of rotation of the double-cone drum;

wherein on an axially lower inside area, the drum bottom part is fastened to the an underside of a lower distributor body; and wherein the distributor body is conically tapered in an upward direction and bounds distributor ducts in a downward direction, which distributor ducts are bounded in an upward direction by a covering and in a circumferential direction by ribs between the covering and the distributor body.

19. The separator according to claim 18, wherein the distributor body has a conical blind hole into which a screw engages.

20. The separator according to claim 18, wherein the distributor ducts are configured such that they guide an outflowing liquid in an area of outlets of the distributor ducts into the drum onto an interior wall of the drum bottom part.

* * * * *